United States Patent [19]

Kucharik et al.

[11] Patent Number: 4,739,986

[45] Date of Patent: Apr. 26, 1988

[54] FOOT, ANKLE AND LOWER LEG EXERCISER

[76] Inventors: Edward J. Kucharik, 2117 49th St. North, St. Petersburg, Fla. 33542; Mitchel E. Thaxter, 2917 13th St. North, St. Petersburg, Fla. 33704

[21] Appl. No.: 58,508

[22] Filed: Jun. 5, 1987

[51] Int. Cl.[4] ..... A63B 23/04

[52] U.S. Cl. ..... 272/96; 272/146

[58] Field of Search ..... 272/96, 97, 111, 146, 272/135–138; 128/25 B

[56] References Cited

U.S. PATENT DOCUMENTS

| | | | |
|---|---|---|---|
| 1,509,793 | 9/1924 | Thompson | 272/96 |
| 1,565,484 | 12/1925 | McWhirter | 272/146 |
| 3,929,329 | 12/1975 | Rivera | 272/97 |
| 4,186,920 | 2/1980 | Fiore et al. | 272/96 |
| 4,199,137 | 4/1980 | Giguere | 272/96 |
| 4,310,155 | 1/1982 | White | 272/136 |

FOREIGN PATENT DOCUMENTS

| | | | |
|---|---|---|---|
| 1372342 | 10/1974 | United Kingdom | 272/146 |
| 1222288 | 4/1986 | U.S.S.R. | 272/146 |

*Primary Examiner*—Richard J. Apley
*Assistant Examiner*—J. Welsh
*Attorney, Agent, or Firm*—Walter J. Monacelli

[57] ABSTRACT

The exerciser described herein for strengthening or rehabilitating the feet, ankles and lower legs of the user comprises two foot pedals supported on a vertical bar screwed into the support for the pedals and having a ball joint at the bottom thereof which fits into a cavity in the base support and thereby permits a swivelling action. Between the pedals and the base support there is also a supporting spring for which the compression can be increased or decreased by turning the threaded part of the bar one way or the other way in a threaded opening in the underside of the pedal supporter.

3 Claims, 1 Drawing Sheet

FOOT, ANKLE AND LOWER LEG EXERCISER

BACKGROUND OF THE INVENTION

1. Field of the Invention

This invention relates to a device for exercising either or both the feet, ankles and lower legs of a patient. More specifically it relates to an exerciser which permits the patient to stand on one or two foot pedals and manipulate the pedals so as to exercies the patient's lower extremities. Still more specifically this exerciser is adapted to provide a swivel action and a spring action for such manipulations.

2. State of the Prior Art

There are numerous patents which describe foot exercising apparatus. Typical examples are the following.

Madsen U.S. Pat. No. 478,166 shows a foot pedal supported on a ball joint which permits the foot to be put through a swivelling action.

Thompson U.S. Pat. No. 1,509,793 describes a foot pedal which is supported off center by a ball joint and has a spring attached at one end to give resiliency.

Anderson U.S. Pat. No. 1,671,096 discloses a device on which each of the patient's feet is held onto a pedal by two sets of straps and the feet are exercised by lifting or bending them against two springs which are fastened to the bottom of the pedal.

Kost U.S. Pat. No. 2,206,902 shows a complicated swivelling device on which the patient's feet are manipulated into various angles and positions.

Conn et al U.S. Pat. No. 3,134,591 described a sporting equipment item on which the user can pivot and spin around.

Piller U.S. Pat. No. 3,525,522 shows a foot exerciser which is supported on an axle which may be positioned at different angles by partial rotation on the axis of the axle.

Flore et al U.S. Pat. No. 4,186,920 discloses a raised device supported on legs which device holds the foot at the top thereof while the foot is put through a manipulative action.

Giguere U.S. Pat. No. 4,199,137 describes an apparatus for foot rehabilitation which comples effort of the foot to execute rotation and lateral and longitudinal rocking of the pedal on which the foot rests.

White U.S. Pat. No. 4,310,155 shows a device for holding a foot in a vertical position while it is being manipulated to develop the lower leg muscles.

OBJECTIVES

It is an object of this invention to design a simple apparatus to provide dynamic movement in a patient's foot-ankle appendage.

It is also an object of this invention in which such apparatus provides inversion, eversion, dorsal flexion, plantar flexion and rotation.

It is also an object of this invention in which such apparatus can be adjusted to give increased spring tension and increased resistance against foot action.

It is also an object of this invention that such apparatus is light weight and is hand portable.

SUMMARY OF THE INVENTION

In accordance with the present invention, apparatus has been designed which accomplishes the above objectives, comprising two foot pedal each which is fixed to and supported by a rod or bar screwed into the base of said pedal, the lower part of said rod or bar comprises a rounded section or ball joint which rests in an opening or recess in a base plate on which the said rod or bar is supported and held in a substantially vertical position. The rod or bar element is surrounded by a heavy spiral spring which has its lower end resting on the said base plate and the upper end thereof pressing directly or indirectly against the underside of said foot pedal. By revolving the foot pedal, so as to advance or retract its threaded portion on the threads of the rod or bar, the pressure on the spring can be increased or decreased and thereby increase or decrease the force necessary to be applied on the foot pedal to turn or bend the same on the supporting ball joint.

The use of this apparatus increases leg circulation, particularly in the lower leg which includes the "venous valves and venous pump" (See pg. 246 "Textbook of Medical Physiology", fifth edition, by Arthur C. Guyton, M.D. 1976). This increases the strength of the lower leg and foot muscles or tendons. It also increases tendon strength around the knee and increases upper leg strength through the stabilization effect required to provide the dynamic movement used in performing the exercises.

By the use of this apparatus there will be a muscle education and thus better coordination of the leg-ankle-foot mechanism. The increased muscle awareness or muscle education provides the user with more responsive natural reflexes, a need in athletic events.

The mechanisms of the apparatus can provide movement of the foot in various planes against a gauged or adjustable resistance thereby providing a state of the art rehabilitating mechanism for injuries of the leg, the knee, the lower leg, the ankle and the foot for a progressive program of rehabilitation.

This apparatus allows dual performance thus permitting the user to work both legs simultaneously. It can be made light weight and therefore transportable by hand. The benefits are numerous and useful for providing circulatory benefits to the athlete, the office worker, body builder or anyone desiring such benefits.

DESCRIPTION OF SPECIFIC EMBODIMENTS

The description of the apparatus of this invention is facilitated by reference to the drawings.

Figure 1:
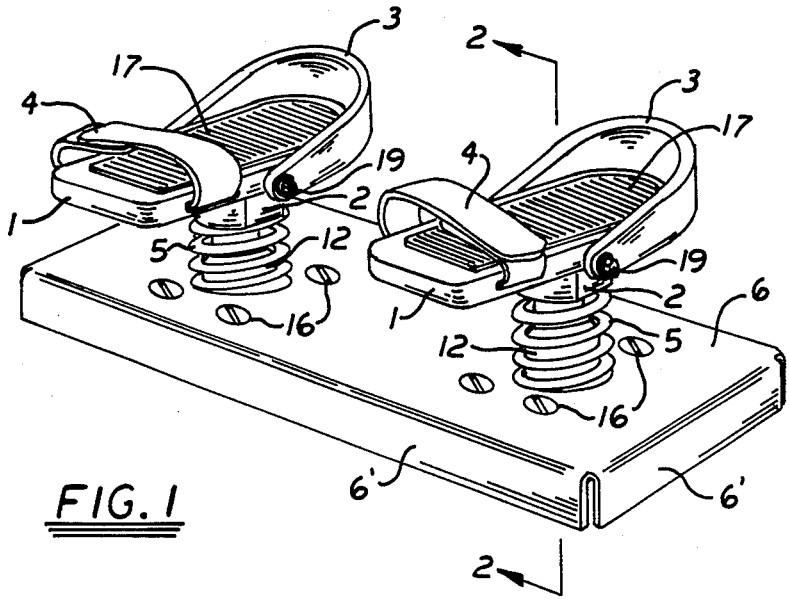
FIG. 1 is a perspective view of a preferred embodiment of this invention.

In FIG. 1 foot pedals 1 are secured to supporting base 2. Heel stop 3 is attached at the rear end of pedal 2 and both parts of a two part strap 4 are attached to the sides of the pedal. The overlapping ends of the strap may be attached to each other by various means such as by a "Velcro" fastener (not visible in this view). Supporting base 2 rests on a heavy spring 5 which in turn rests on base plate 6 for which bent over portions 6' form supporting legs.

Figure 2:
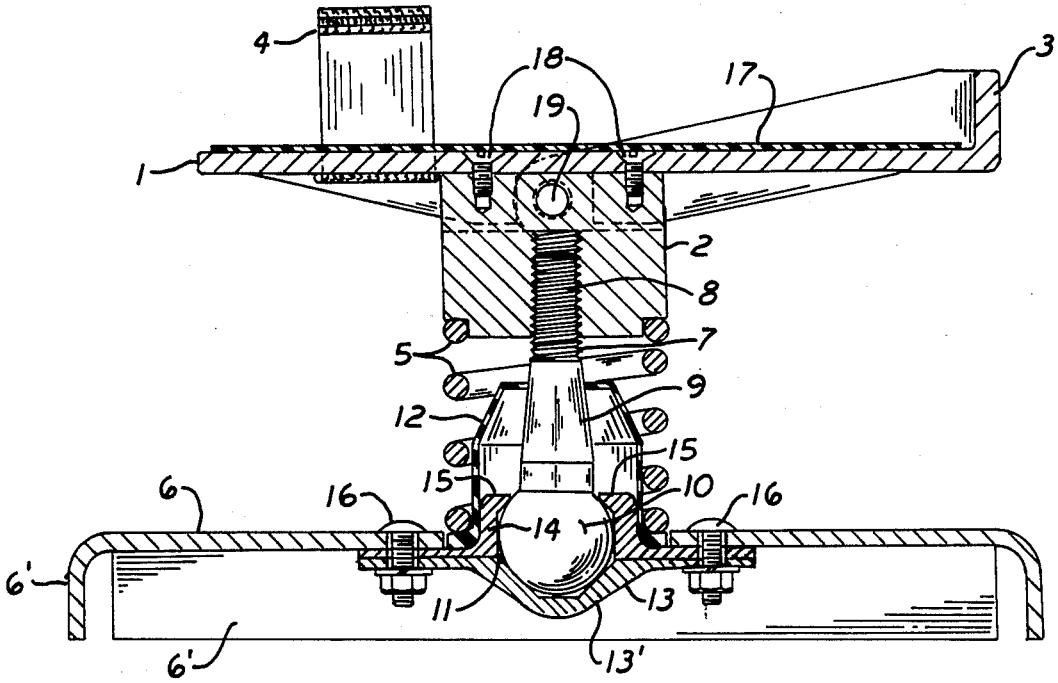
FIG. 2 is a cross-sectional view of this preferred embodiment taken at line 2—2 of FIG. 1.

The cross-sectional view of FIG. 2 shows the structure of bolt 7 which has an upper threaded portion which fits into the threads of threaded opening 8 of supporting base 2. The lower portion of bolt 7 broadens into tapered section 9 and ends in the rounded portion or ball joint 10 which fits into a recess 11. Rubber boot 12 fits around the tapered portion 13 and inside spring 5. Spring 5 may have its lower end resting directly on the base plate 6 or as shown in FIG. 2 may rest on the lower edge of rubber boot 12. Recess 11 is formed by two plate section, namely lower plate 13 which has a curved section 13' forming the lower portion of the recess 11 and upper plate 14 which forms the portion which embraces the top portion of ball joint 10 by virture of protruding lips 15 extending from upper plate 14. Upper plate 14 and lower plate 13 are held together and to the underside of base plate 6 by means of bolts 16. Skid resistant pads 17 are placed on the pedals 1 and are preferably adhered thereto, whereby the user's feet are prevented from slipping on the surface of the pedals. Bolts 18 fasten the pedals 1 to supporting base 2. Bolts 19 are used to fasten heel stops 3 to the pedals 1.

The degree of tilting of the pedals can be controlled by the positioning of the protruding lips 15. The farther these lips are positioned from the lower portion 9 of bar 8 when the bar is in a vertical position, the greater will be the degree of tilting allowed for the pedal. Where these lips are close to portion 9 the allowed tilting will be more limited.

OPERATION OF THE APPARATUS

The user of this apparatus stands on the pedals and straps his feet thereto. Then by shifting his weight and manipulating his feet to tilt the pedals in various directions against the resistance offered by the spring to such movement, the feet, ankles and lower legs are exercised. This resistance and the resultant force required by the lower extremities to tilt the pedals may be adjusted by rotating the pedals on the threaded supporting rod so that the comprssion on the spring may be increased or decreased. As the pedals are rotated so as to press down on the springs, the compression on the spring and therefore the force required to tilt the pedals by the user's pressure thereon is increased. When the direction of rotation of the pedals is reversed, the compression on the spring is decreased and thereby the force required to tilt the pedals is decreased.

In summary the apparatus comprises pedal means on which the user places his feet, a strapping means by which the user's feet are fastened to the pedal means, pedal supporting means to which said pedals are affixed each of which has a threaded opening in the underside thereof; a base supporting means having a receptacle cavity in the upper portion thereof, a bar supporting means having threads at one end and having at the other end a ball or rounded shape adapted to fit into the receptacle cavity of said base supporting means and the threads on said bar supporting means being adapted to fit into and engage the threaded opening in said pedal supporting means, and a spiral spring positioned between said pedal means and said base supporting means, whereby rotation of the pedal means in one direction around the bar supporting means decreases the distance between the pedal means and the base supporting means thereby compressing said spring, and rotation of the pedal means in the other direction around the bar supporting means increases the distance between the pedal means and the base supporting means thereby decreasing the compression of the spring. It is contemplated that the pedal means and the pedal supporting means may be integrated in one piece so that it serves both of these functions.

In initiating exercise on this apparatus the springs are placed under lower compression so that the user may more easily tilt and manipulate the pedals with his lower extremities. Then as the exercise strenghtens the muscles and tendons of the feet and lower legs, the compression on the springs may be increased as described above and thereby require greater force by the user to manipulate and tilt the pedals. This requirement for greater force still further builds up the muscles and tendons.

As previously stated, the use of this apparatus results in improved muscle awareness or muscle education and thereby provides the user with more responsive natural reflexes, a desirable condition for athletic events. Moreover where there has been an injury or a weakness or debilitation, the exercise acquired by the use of this apparatus provides a progressive program of rehabilitation and strengthening of the various muscles and tendons.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claimed is:

1. Apparatus for the rehabilitation and strenghtening of the muscles and tendons in a person's feet, ankles and lower legs comprising (a) two separate pedal means on which a user may place his feet, one foot on each pedal means; (b) strapping means by which the feet may be fastened to said pedal means; (c) two pedal supporting means to which said two pedal means are affixed, each said pedal supporting means having a threaded opening in the underside thereof; (d) a base supporting means having two receptacle cavities in the upper portion thereof; (e) two supporting means each having threads at one end and having at the other end a rounded shape adapted to fit into one of said receptacle cavities of said base supporting means, said threads on said bar supporting means being adapted to fit into and engage the threaded opening in one of said pedal supporting means; and two spiral springs positioned between said pedal supporting means and said base supporting means, whereby rotation of the pedal means in one direction around said bar supporting means decreases the distance between said pedal means and said base supporting means thereby compressing said spring, and rotation of the pedal means in the other direction around said bar supporting means increase the distance between said pedal means and said base supporting means thereby decreasing the compression of said spring, in which apparatus there is a restraining means which prevents the removal of said rounded shape end of said bar supporting means from said receptacle cavity.

2. The apparatus of claim 1 in which said base supporting means includes a lower plate having said receptacle cavity therein and said restraining means comprise an upper plate having an opening therein having a diameter smaller than the diameter of said rounded shape of said bar supporting means, said lower and upper plates having means for fastening themselves to each other with the said rounded shape of said bar supporting means being contained therebetween with the upper portion of said bar supporting means extending through the opening in said upper plate.

3. The apparatus of claim 2 which also comprises a base to which both said upper and lower plate are fastened.

* * * * *